United States Patent [19]

Goldfarb et al.

[11] Patent Number: 4,475,304

[45] Date of Patent: Oct. 9, 1984

[54] TOY VEHICLE APPARATUS FOR WEIGHT PULLING

[75] Inventors: Adolph E. Goldfarb, 1432 S. East Wind Cir., Westlake Village, Calif. 91361; Delmar K. Everitt, Woodland Hills, Calif.

[73] Assignee: Adolph E. Goldfarb, Westlake Village, Calif.

[21] Appl. No.: 347,452

[22] Filed: Feb. 10, 1982

[51] Int. Cl.[3] ..... A63H 17/00

[52] U.S. Cl. ..... 446/465; 213/75 TC; 280/490 R

[58] Field of Search ..... 46/201, 202, 206, 223, 46/251, 216, 218, 11; 213/75 TC; 280/759, 490 R, 495–497, 758; 73/862.03

[56] References Cited

U.S. PATENT DOCUMENTS

| | | | |
|---|---|---|---|
| 875,519 | 12/1907 | Haberlin | 213/75 TC |
| 1,248,619 | 12/1917 | Chein | 46/218 |
| 2,035,302 | 3/1936 | Decker | 46/201 X |
| 2,038,769 | 4/1936 | Stillwell | 46/11 |
| 3,154,882 | 11/1964 | Bossiere | 46/11 |
| 3,367,441 | 2/1968 | Schuster | 280/759 |
| 3,491,590 | 1/1970 | Watkins | 73/862.03 |
| 3,741,010 | 6/1973 | Luedtke | 73/862.03 |

OTHER PUBLICATIONS

Schaper–"Official Stomper ® Pull Set TM", No. 802.

*Primary Examiner*—F. Barry Shay

*Attorney, Agent, or Firm*—Romney, Golant, Martin & Ashen

[57] ABSTRACT

Toy apparatus including an assembly for coupling a self-powered 4-wheel drive toy pulling vehicle to a toy sled which provides a variable resistance or drag to test the pulling power of the vehicle. The toy apparatus simulates in a simplified and economical way its full-scale counterpart; in particular it provides for variations (such as in weight amount and location and coupling configuration) permitted or demanded by rules of competitive load-pulling events. The coupling assembly includes a harness mounted on the pulling vehicle and providing an upright transversely extending tab or bar, and a tongue pivotally mounted on the sled and having a transversely extending slot for receiving the tab. The tongue is pivoted about an axis generally parallel to the ground. This coupling tends to keep the toy vehicle-sled combination moving in a straight line and limits any tendency to veer off to the side. The pulling advantage of the vehicle may be changed by changing the tongue inclination or hitch height by use of one of a plurality of supplements which fit on the tab. The harness is also provided with a plurality of receptacles for weights to load either or both the front and rear of the vehicle to maintain wheel traction. The harness releasibly fits a standard size toy vehicle chassis which supports a plurality of different vehicle bodies so the coupling assembly can be used with many different pulling vehicles.

19 Claims, 5 Drawing Figures

TOY VEHICLE APPARATUS FOR WEIGHT PULLING

BACKGROUND OF THE INVENTION

The present invention relates to self-powered toy vehicles, and more particularly to coupling together of multi-unit toy vehicles.

So called "pulls" or load-pulling competitions have a long history. Originally horses pulled weighted wagons. Then tractors were used to pull loads. More recently four-wheel off-the-road vehicles have been used to pull loads. These competitions have been organized to a lesser and greater extent. There are rules and parameters for entry, and for participation; there are promoters, judges, entry fees and prizes; there are various classes or levels of competition based on such things as types and modifications of the vehicles, and the loads.

A recent development has been a variable-resistance sled which increases resistance the further the load is pulled. Such a sled comprises an elongated platform supported on wheels at its rear end. The platform is inclined upwardly toward its forward end which is supported by a skids. A weight receiving car or carrier rests upon the platform and is movable, as the sled is pulled, from the rear toward the front of the platform. This shifts weight on the platform from the rear wheels to the skids, and thus increases the resistance of the platform to being pulled forward. Contestants take turns using their vehicles to pull the sled. Contestants who are successful in pulling a given load the full length of the course, then go on to compete in the next round, pulling a greater load, etc. The contestant's pulling vehicles may be appropriately weighted in both the front and back to maintain wheel traction, according to competition rules. By this means, owners, dealers, and users of vehicles are able to demonstrate the power and pulling force of the vehicles manufactured, sold modified and/or maintained by them.

The development and production of a miniature self-powered 4-wheel drive toy vehicle sold under the trademark, "STOMPERS" by Schaper Manufacturing Co. provided the basis for competitions using toy replicas of the life-size or full-scale 4-wheel drive pulling vehicles. In these toy competitions rules have been established regarding class weights, etc. paralleling the rules for the life size competitions. In the toy vehicle competitions, contestants normally vie over a straight course or track of six to eight feet. The toy pulling vehicles pull a weighted sled similar to that described above either in a distance competition or in a timed competition. As with their life-size counterparts, there are rules relating to the amount of weight which may be loaded on the sled and/or on the front and rear ends of the pulling vehicle. Similarly, there are rules with respect to the nature of the coupling between the sled and the pulling vehicle; in particular there are rules with respect to the height of the hitch on the pulling vehicle to which the sled may be coupled.

However, due to the dramatically different orders of magnitude of force, weight, friction and other elements pertinent to the operation of a toy vehicle as contrasted with an actual full-scale vehicle, various couplings, structures and methods for utilizing such forces or operative elements must be designed, arranged, configured and proportioned differently than for their life-size counterparts. Further, because of cost considerations, the toy counterparts must achieve generally comparable ends in simplified or otherwise modified ways. Further, the toy vehicles have no drivers to compensate for events that may occur in the operation of the vehicles.

One particular need is for a means for coupling such toy pulling vehicles to a toy sled that is simple and economical to produce and to use while simulating the basic features of the full scale counterpart. A major problem which has been encountered in the past is the tendency of the unmanned self-powered toy pulling vehicle attached to the sled as by means such as a simple string to tend to jackknife or veer off to one side, especially when heavier loads are being pulling. In addition, it is desirable that the means for coupling the sled and pulling vehicle be adjustable or variable in the same ways as their full scale counterparts so as to emulate full scale competitions. It is also desirable that the same coupling means accomodate a plurality of different toy pulling vehicles.

These and other objects of the invention can better be understood by considering the following description.

BRIEF SUMMARY OF THE DISCLOSURE

The disclosed form of the present invention comprises an improved toy vehicle apparatus comprising a self-powered toy 4-wheel drive pulling vehicle which is coupled to and pulls a weighted toy sled over a surface. The coupling is achieved by a coupling assembly which includes a harness that is supported on the chassis of the pulling vehicle. A plate-like upright transversely extending tab is mounted on the harness at the rear of the toy pulling vehicle. A tongue is mounted on the sled and is rotatable about an axis which is generally parallel to the ground or surface. The tongue has an elongated transversely extending slot which receives the plate-like tab. This connection allows for up-and-down movement between the pulling vehicle and the sled but tends to restrict side-to-side movement as between them so they will move forward in a straight line. This is an important feature for a non-maned toy, since there is no driver as with full scale vehicles to steer the vehicles and compensate for any tendency to veer off to one side or the other.

In another aspect of the invention, the effective height of the basic tab on the pulling vehicle is increased by adding a selected one of a plurality of supplemental tabs of different heights.

The illustrated harness has weight holding receptacles at its front and its rear to maintain the front and rear wheels respectively in driving contact with the ground as the vehicle exerts pulling force. When dealing with 4-wheel drive vehicles it is important that all 4 wheels maintain driving contact with the ground during the pulling operations. The pulling vehicle has a generally rectangular chassis. The harness has a generally rectilinear open lower frame section which engages the lower portion of the chassis, and front and rear retaining means which releasibly engage the front and rear upper portions of the chassis respectively to maintain the harness on the chassis. The retaining means may flex to receive the chassis or one of the retaining means may be rotatably mounted and biased.

The various embodiments of the present invention and its operation may be better understood by considering the following Figures.

DETAILED DESCRIPTION OF THE PREFERRED EMBODIMENTS

Figure 1:
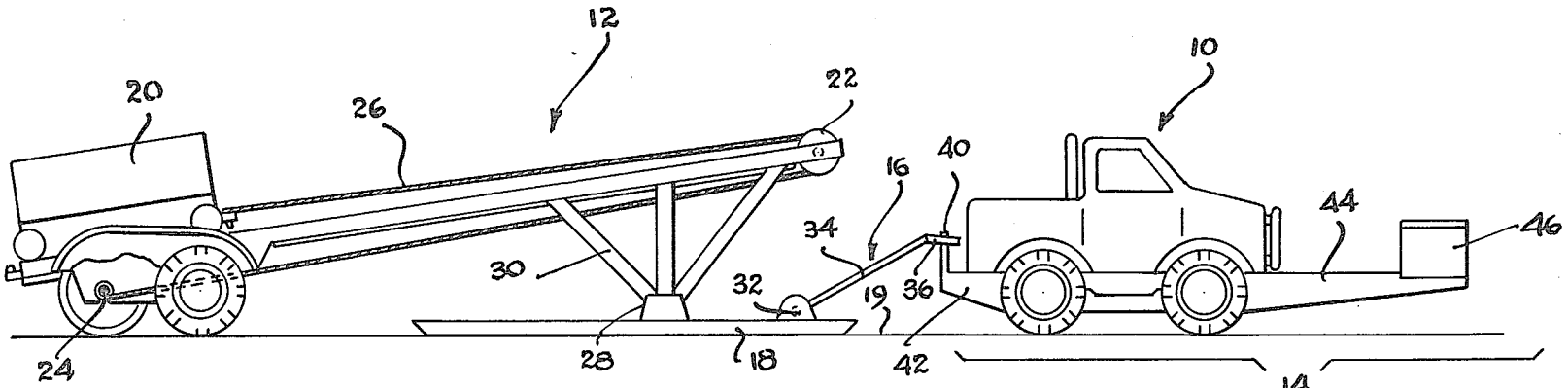
FIG. 1 is a side elevational view of a toy apparatus embodying the invention, comprising a coupling assembly connecting a toy pulling vehicle to a weighted sled.
Figure 2:
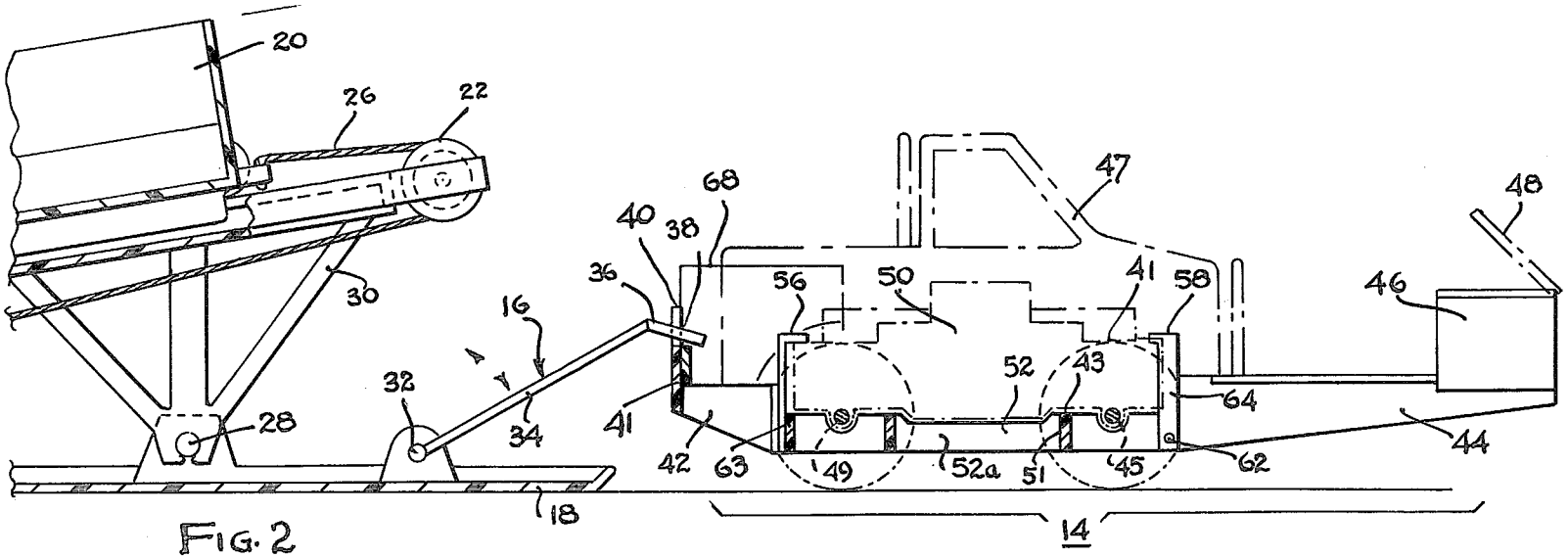
FIG. 2 is an enlarged side elevational view (partially broken away and in section) of the toy apparatus.

FIG. 1 shows toy apparatus which includes a toy pulling vehicle 10 and a toy variable-resistance sled 12 which replicate full size apparatus used in towing competitions. Pulling vehicle 10 is coupled to sled 12 by a means of a coupling assembly. The coupling assembly includes a harness 14 which is mounted on the pulling vehicle 10 and has an upright tab or bar 40 that couples with a tongue 16 on the sled 12. The front portion of sled 12 rests upon a skid 18 which is in frictional contact with the ground or surface 19 over which vehicle 10 is to pull the sled 12. Sled 12 is inclined upwardly toward its front end and supports a wheeled movable cart 20 on its upper surface. The cart 20 defines a receptable for receiving weights. As sled 12 is pulled forward by vehicle 10, the cart 20 is drawn forwardly up the incline of sled 12. A string 26 tied to cart 20 extends forwardly around a pulley 22 rotatably mounted on the front end of the sled and back to sled rear axle 24, to which it is also tied. More particularly, the string 26 is attached to a point on the periphery of the axle 24 such that as axle 24 rotates, string 26 is wound around the axle, causing weighted cart 20 to be moved toward the front of sled 12 as shown in FIG. 2. This increases the amount of weight on skid 18, increasing the amount of friction between skid 18 and the ground and increasing the resistance of sled 12 to being pulled by vehicle 10. More weights may be added to the cart for subsequent runs in a competition. Skid 18 may be stipled or roughened on its lower surface to maximize the amount of frictional contact with the ground. Alternatively, a layer of high friction material such as rubber may be secured to the underside of the skid. Skid 18 is rotatably coupled at pivot 28 to struts 30 that depend from the underside of the sled to insure that skid 18 remains in flat and full contact with the ground.

FIG. 2 illustrates in greater detail a side view of coupling assembly. The tongue 16 is rotatably coupled to skid 18 by a restricted pivot 32. Pivot 32 allows rotation of tongue 16 only about an axis generally parallel to the ground but does not permit movement side-to-side or transversely. Tongue 16 includes a body portion 34 that extends from pivot 32 to a flattened end portion 36 which has an elongated transverse slot 38. In normal usage, body portion 34 is inclined upwardly in the forward direction while flattened end portion 36 is generally parallel to the ground. Slot 38 is proportioned to receive the plate-like transversely extending upright tab 40 which is formed as part of the rear end-portion of the harness 14.

Figure 3:
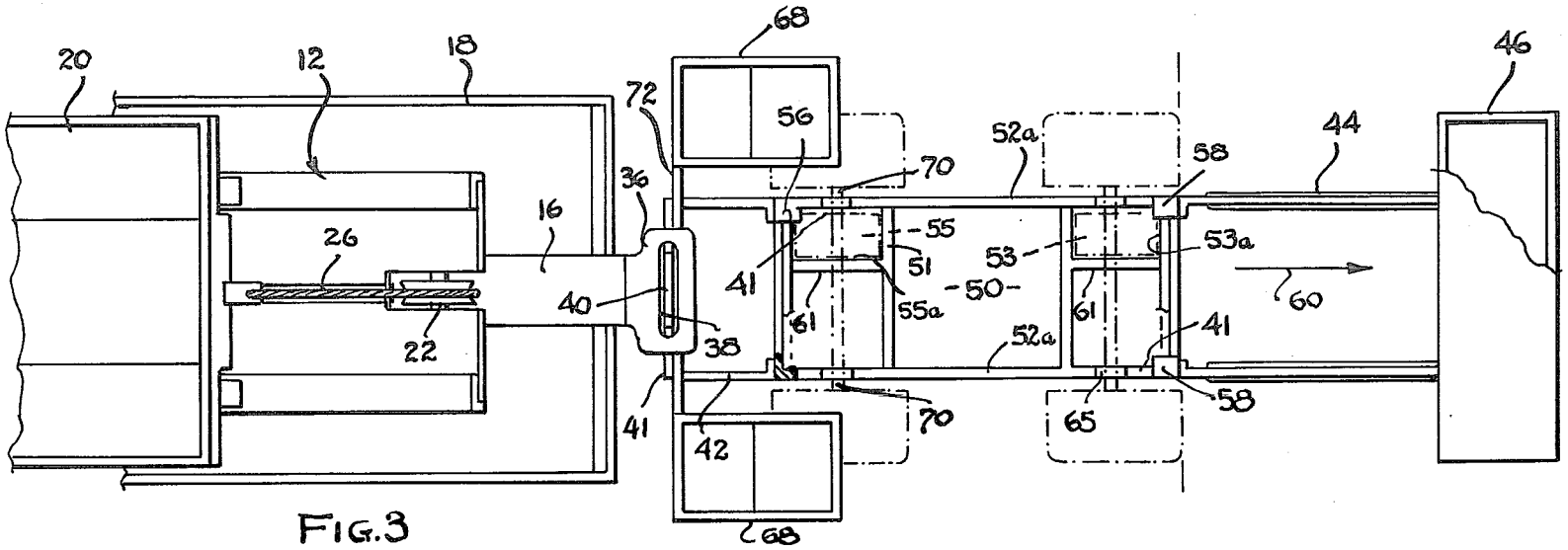
FIG. 3 is a top plan view of the toy apparatus.

Tab 40 is mounted on a transversely extending bar 41 that is supported between the rear ends of a pair of arms 42 which extend rearwardly from the rear of a lower box-frame portion 52 of the harness. In the illustrated embodiment, vehicle 10 has a generally rectilinear box-like chassis 50 on which the harness 14 is releasibly mounted, and a vehicle over-body 47 which releasibly attaches to the chassis. A pair of cantilevered arms 44 extend forwardly from the front end of the lower box frame portion 52 of the harness. Arms 44 support a weight-receiving front receptacle 46. Weight is placed in receptable 46 to maintain the front wheels of the pulling vehicle in contact with the ground during the pulling operation. A variable amount of weight is placed by the user in receptacle 46 according to the weight to be pulled on sled 12 and the power of the pulling vehicle as determined by the class competition rules. Receptacle 46 may be open at its top but in the illustrated embodiment it includes a lid 48 to insure the retention of the weights. Receptacle 46 is detachable from arms 44 and is adjustably coupled thereto by conventional means to permit selective positioning of the receptacle 46 along the arms 44. Various sized receptacles 46 may be alternatively couple to arms 44 according to competition rules. In addition to such front weight, rear arms 42 may also detachably support, as shown in FIG. 3, a multi-section receptacle 68 for adding weight at the rear of vehicle 10 to maintain the rear wheels in contact with the ground during pulling. Receptacle 68, has a spaced-apart pair of sections which are connected together by a transverse bar 72. The rear receptable 68 may be selectively mounted on the harness 14 with the sections disposed to either side of the rear of the vehicle 10. Receptables sections 68 may also be provided with lids to securely retain the weights. As noted above, to maximize pulling by a 4-wheel drive vehicle, it is necessary that all four wheels maintain their driving contact with the ground during the pulling operations.

The outline of the chassis 50 of vehicle 10 is shown somewhat schematically in broken line in FIG. 2. In the lines of toy vehicles sold under the "STOMPER" trademark, a plurality of toy vehicles have the identical chassis 50 which will receive various different vehicle bodies 47. Thus, a single harness 14 may be provided which fit such a chassis and will thereby fit all of the vehicles in such a line of toy vehicles. The illustrated chassis 50 is generally a rectangular box. The harness 14 encases the chassis in such a way as to restrict movement between them in all directions. The harness 14 is coupled to the chassis 50 by means of the lower rectangular box-like open base portion 52 interengaging lower portions of the chassis, while retaining means in the form of clips 56 and 58 mounted on lower portion 52 enclose and grasp upper portions of the chassis.

More particularly, the chassis 50 has a generally rectangular upper peripheral edge 41 and a generally rectangular lower peripheral edge 43. The chassis 50 also has front and rear wheel-axle housing sections 45, 49 which depend from and extend transversely across the underside of the chassis adjacent its front and rear ends respectively. The chassis is also formed with a pair of gear housing sections 53, 55 which depend from the underside of the chassis, one adjacent each end. As shown in FIG. 2, each gear housing section 53, 55 is semi-circular as viewed from the side; as shown in FIG. 3, one gear housing section 53 is located adjacent the front end of the chassis at one side thereof, while the other gear housing section 55 is located adjacent to the rear end of the chassis at the same side thereof.

The harness base portion 52 comprises a pair of upright side walls 52*a*and a pair of upright end walls 63.

Base portion 52 also includes a pair of upright transverse intermediate walls 51, each spaced from one of the end walls 63 sufficiently to receive one of the depending gear housing sections 55, 53 between that intermediate wall 51 and the adjacent end wall 63. Between each end wall 63 and the adjacent intermediate wall 51 there is a longitudinally extending upright wall 61. Each of the walls 61 is spaced from one of the side walls **52*a* sufficiently to receive one of the depending gear housing sections 55, 53 between that wall 61 and that side wall 52*a*. The side walls 52*a* also have notches 65 for receiving the wheel-axle housing sections 45, 49. The lower part of the chassis engages the harness lower base portion 52, with the lower peripheral edge 43 of the chassis abutting the side walls 52*a* and end walls 63, with end portions of the transverse wheel-axle housing sections 45, 49 received in the notches 65, and with the depending gear housing sections 55, 53 received in the confined recesses or spaces 55*a*, 53*a* defined by side walls 52*a*, end walls 63, walls 61 and portions of intermediate walls 51. With the harness in this position on the chassis, side-to-side and front-to-back transverse or lateral relative movement between chassis and harness is limited. It will be noted that the vehicle wheels are disposed outwardly of the side walls 52*a* and extending below those side walls. The retaining means maintain the harness in this position on the chassis. More particularly, there are four upstanding clips, 56, 58, one at each corner of the base portion 52. Each clip comprises an upright section which terminates at its upper end with an inwardly directed retaining section. The distance between the lower engaging edges of the retaining sections of clips 56 and 58, and the upper edges of the walls of the base portion 52 approximates the distance between upper periphery 41 and lower periphery 43 of the chassis so that a relatively snug fit is achieved. In one embodiment, clips 56 and 58 are integrally formed with the base portion 52 and are sufficiently flexible so as to snap-fit over the upper periphery 41. In this form, the harness and the clips may be a single molded plastic part having a degree of flexibility and resilience. In the embodiment particularly illustrated in FIG. 2, front clips 58 are pivoted at their lower ends and biased to the positions shown by suitable spring means (not shown) to accommodate the chasis being assembled into the harness. In this form, the harness and rear clips may be a single part, with the front clips being separate pieces. After the harness 14 is assembled on the chassis 50, the vehicle body 47 then is releasibly attached by conventional means to the chasis in a position as shown in FIG. 2**.

The operation of the coupling assembly may be better understood by viewing FIG. 3 which is a top plan view of that assembly. FIG. 3 clearly shows that plate-like tab 40 is generally upright and lies in a plane perpendicular or transverse to the direction of travel 60. It also shows the flattened end portion 36 of tongue 16 with its enlongated transverse slot 38 which receives tab 40. By virtue of the slot and tab coupling of tongue 16 to harness 14 in combination with the restricted pivot 32, the travel of sled 12 and pulling vehicle 10 are maintained in a generally parallel and forward direction. It is not possible, given this coupling, for sled 12 to jackknife with respect to vehicle 10. This is acheived despite differences in the traction between the wheels and the ground, and other forces that may tend to cause the vehicles to veer off to the side. This is important in this toy apparatus since there is no driver as in the life size version to adjust the course of the pulling vehicle as pulling progresses.

Figure 5:
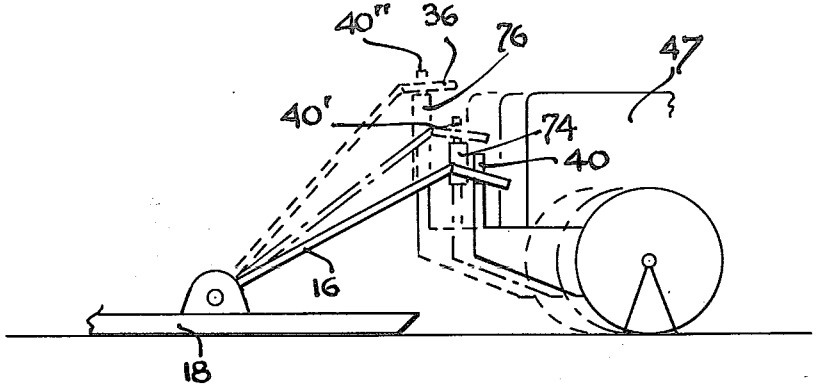
FIG. 5 is a simplified side view further illustrating the variable height coupling.
Figure 4:
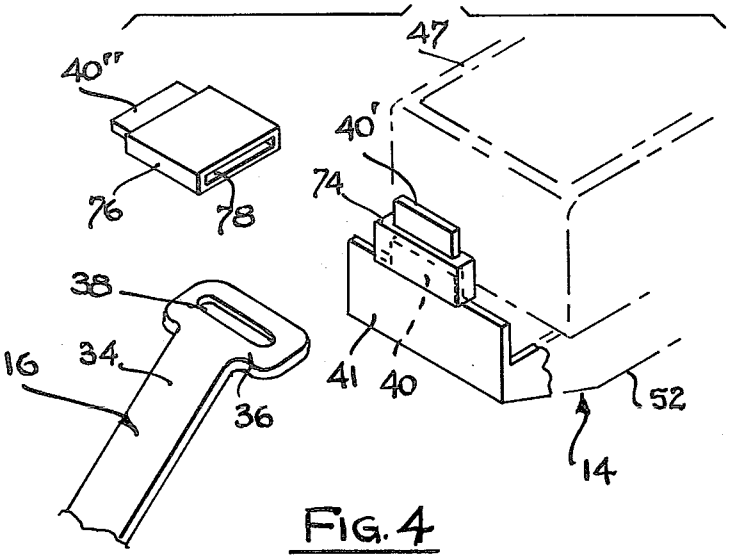
FIG. 4 is a perspective end view showing the manner in which the coupling height is varied.

FIGS. 4 and 5 illustrate a feature for following competition rules by varying the hitch height in relation to the load being pulled. The hitch height is varied by providing means to vary the height of the tab. The lowest height is provided by the "stock" position defined by tab 40 in its intrinsically formed position as part of harness 14. One of a plurality of supplements 74, 76 may be placed on tab 40 to vary the hitch height. Each of the supplements is provided with a tab for engagement with the slot 38 of tongue 16. For example, supplement 74 is provided as a "super stock" hitch which adds a quarter-inch in height to the pre-existing one inch hitch height provided by the "stock" position. A second, larger supplement 76 is provided to define a "modified" hitch by adding one-half inch of additional hitch height. Each supplement 74, 76 has a tab 40' and 40" for engagement with tongue 16 and a rectangular cavity 78 to receive and be mounted on tab 40. The three positions of tongue 16 are diagrametically shown in FIG. 5.

Although the present invention has been described in connection with a particularly illustrated embodiment, it must be kept in mind that the spirit and scope of the present invention is not to be limited by the illustrated embodiment which has been described only for the purposes of clarification. Many alterations and modifications may be made by those having ordinary skill in the art without departing from the scope of the invention as set forth in the following claims.

What is claimed is:

1. Toy apparatus for coupling a self-powered toy pulling vehicle to a toy weighted vehicle for pulling the weighted vehicle along a supporting surface, said coupling apparatus comprising:

a transversely extending upright plate-like tab element adapted to be mounted on one of such vehicles, said tab element being stabilized against lateral rotation relative to that one vehicle; and a tongue element adapted to be movably mounted on the other of such vehicles, said tongue element:

being particularly adapted to be stabilized against lateral rotation relative to that other such vehicle, being particularly adapted to be generally vertically movable relative to that other such vehicle, having an elongated transversely extending slot which receives said plate-like tab element to couple such pulling vehicle to such weighted vehicle, and being particularly adapted to be firmly but rotatably mounted to that other such vehicle for substantial movement about a transversely extending axis which is generally parallel to said surface;

comprising a first section and a second section; said first section being pivotally mounted at one end in close proximity to such surface and being connected at its other end to the second section; said tongue element being disposed when it is coupled to said tab element such that said first section extends forwardly and upwardly from where it is pivotally mounted, and said second section being disposed in a generally horizontal plane generally parallel to such surface; and said plate-like tab element extending in a plane which is generally parallel to said axis of said tongue element;

whereby, when such pulling vehicle pulls such weighted vehicle over the surface, such coupled vehicles are maintained in generally straight-line longitudinal alignment and they thereby move in a generally straight line in the forward direction without veering to either side.

2. The toy apparatus of claim 1, in further combination with one of each of such vehicles.

3. Toy apparatus for coupling a self-powered toy pulling vehicle to a toy weighted vehicle for pulling the weighted vehicle along a supporting surface, said coupling apparatus comprising:

a transversely extending upright plate-like tab element adapted to be mounted on one of such vehicles, said tab element having a variable height with respect to such surface and being stabilized against lateral rotation relative to that one vehicle;

a tongue element adapted to be movably mounted on the other of such vehicles, said tongue element:

being particularly adapted to be stabilized against lateral rotation relative to that other such vehicle, being particularly adapted to be generally vertically movable relative to that other such vehicle, and having an elongated transversely extending slot which receives said plate-like tab element to couple such pulling vehicle to such weighted vehicle; and means for varying the height of said tab element with respect to said surface;

whereby, when such pulling vehicle pulls such weighted vehicle over the surface, such coupled vehicles are maintained in generally straight-line longitudinal alignment and they thereby move in a generally straight line in the forward direction without veering to either side.

4. The toy apparatus of claim 3, in further combination with one of each of such vehicles.

5. The toy apparatus of claim 3 wherein:

said height-varying means comprise a plurality of supplemental tab members; and said height is varied by adding a selected one of the plurality of supplemental tab members to said tab element;

each supplemental tab member having means for being disposed upon said tab element and means defining a supplemental tab for coupling to said tongue element.

6. The toy apparatus of claim 5, in further combination with one of each of such vehicles.

7. Toy apparatus for coupling a wheeled, self-powered toy pulling vehicle to a toy weighted vehicle for pulling the weighted vehicle along a supporting surface, thereby to play-test the traction of the wheels of such pulling vehicle on such supporting surface, and particularly for use with such a pulling vehicle that has rear wheel means which are driven, said coupling apparatus comprising:

a transversely extending upstanding plate-like tab element adapted to be mounted on one of such vehicles, said tab element being stabilized against lateral rotation relative to that one vehicle;

a tongue element adapted to be movably secured to the other of such vehicles, said tongue element:

being particularly adapted to be stabilized against lateral rotation relative to that other such vehicle, being particularly adapted to be substantially vertically movable relative to that other such vehicle while remaining firmly secured thereto, and having an elongated transversely extneding slot which receives said plate-like tab element to couple such pulling vehicle to such weighted vehicle; and a harness adapted to be releasably mounted on such pulling vehicle, adapted to be repeatedly demounted and releasably remounted on such pulling vehicle, and supporting one of said coupling elements;

whereby, when such pulling vehicle pulls such weighted vehicle over the surface, such coupled vehicles are maintained in generally straight-line longitudinal alignment and they thereby move in a generally straight line in the forward direction without veering to either side; and wherein said harness supports weighted means at the rear of such pulling vehicle to maintain said rear wheel means of that vehicle in driving traction with the surface.

8. The toy apparatus of claim 7, in further combination with one of each of such vehicles.

9. The toy apparatus of claim 7, particularly for use with such a pulling vehicle that has front wheel means which are also driven, and wherein:

said harness also supports weighted means at the front of such pulling vehicle to maintain said front wheel means of that vehicle in driving traction with such surface.

10. The toy apparatus of claim 9, in further combination with one of each of such vehicles.

11. Apparatus for coupling a toy pulling vehicle to a toy weighted vehicle for pulling the weighted vehicle over a supporting surface, said pulling vehicle having a generally rectangular chassis with an upper and a lower peripheral edge, and having both front and rear wheel means that are driven, said coupling apparatus comprising:

a first coupling element adapted to be mounted on such a weighted vehicle;

a harness that:

is adapted to be releasably attached, and is adapted to be repeatedly and releasably reattached, to such a pulling vehicle, has a lower portion for engaging the lower peripheral edge of such a pulling vehicle chassis, has retaining means on said harness lower portion for engaging the upper peripheral edge of such chassis to retain said harness on such chassis, and has weight means supported at both the front and the rear of the harness for maintaining such front and rear wheel means of such pulling vehicle in contact with such supporting surface during pulling operations, the front weight means being supported on a forward portion of cantilever arm means extending forwardly from said harness so as to space said front weight means a substantial distance in front of the front end of such pulling vehicle; and a second coupling element supported by the harness, and adapted to be mounted on such a pulling vehicle by means of the harness, for releasably coupling with the first coupling element.

12. The toy apparatus of claim 11, in further combination with one of each of such vehicles.

13. The apparatus of claim 11 wherein said front weight means is adjustably positionable along said arm means.

14. Apparatus for coupling a toy pulling vehicle to a toy weighted vehicle for pulling the weighted vehicle over a supporting surface, said coupling apparatus comprising:

a generally rectangular chassis for such a pulling vehicle, the chassis having an upper and a lower peripheral edge;

a first coupling element adapted to be mounted on such a weighted vehicle;

a harness that:

is adapted to be releasably attached, and is adapted to be repeatedly and releasably reattached, to such a pulling vehicle, has a lower portion for engaging the lower peripheral edge of such a pulling vehicle chassis, and has retaining means on said harness lower portion for engaging the upper peripheral edge of such chassis to retain said harness on such chassis;

a second coupling element supported by the harness, and adapted to be mounted on such a pulling vehicle by means of the harness, for releasably coupling with the first coupling element; and a plurality of different vehicle bodies each adapted for releasable assembly onto said one pulling vehicle chassis.

15. Apparatus for coupling a toy pulling vehicle to a toy weighted vehicle for pulling the weighted vehicle over a supporting surface, such pulling vehicle having a generally rectangular chassis with an upper and a lower peripheral edge, and such chassis having at least one section depending from its lower portion; said coupling apparatus comprising:

a first coupling element adapted to be mounted on such a weighted vehicle;

a harness that:

is adapted to be releasably attached, and is adapted to be repeatedly and releasably reattached, to such a pulling vehicle, has a lower portion for engaging the lower peripheral edge of such a pulling vehicle chassis, and has retaining means on said harness lower portion for engaging the upper peripheral edge of such chassis to retain said harness on such chassis, and has a recess for receiving such depending chassis section therein to limit relative lateral movement between such chassis and said harness;

a second coupling element supported by the harness, and adapted to be mounted on such a pulling vehicle by means of the harness, for releasably coupling with the first coupling element.

16. The apparatus of claim 15 wherein said relative lateral movement is limited both side-to-side and front-to-back.

17. The apparatus of claim 16 wherein said retaining means limit relative movement between such chassis and the harness in the verticle direction.

18. Toy apparatus for coupling to a self-powered toy pulling vehicle and for operation along a supporting surface, said apparatus comprising:

a weighted vehicle that comprises a skid surface for sliding along such supporting surface, said skid surface having a layer of relatively high friction material secured thereto;

a transversely extending upright plate-like tab element adapted to be mounted on one of such pulling vehicle and the weighted vehicle, said tab element being stabilized against lateral rotation relative to that one vehicle; and a tongue element adapted to be movably secured to the other of such pulling vehicle and the weighted vehicle, said tongue element:

being particularly adapted to be stabilized against lateral rotation relative to that other vehicle, being particularly adapted to be substantially vertically movable relative to that other vehicle while remaining firmly secured thereto, and having an elongated transversely extending slot which receives said plate-like tab element to couple such pulling vehicle to the weighted vehicle;

whereby, when such pulling vehicle pulls said weighted vehicle over the surface, these coupled vehicles are maintained in generally straight-line longitudinal alignment and they thereby move in a generally straight line in the forward direction without veering to either side.

19. In combination, toy apparatus for coupling a wheeled toy pulling vehicle to a toy weighted vehicle, to pull the weighted vehicle over a supporting surface and thereby to play-test the traction of the wheels of such pulling vehicle on such supporting surface, together with one of each of such vehicles; said combination comprising:

a wheeled toy pulling vehicle having a generally rectangular chassis with an upper and a lower peripheral edge;

a toy weighted vehicle;

a first coupling element adapted to be mounted on the weighted vehicle;

a harness that:

is adapted to be releasably attached, and is adapted to be repeatedly and releasably reattached, to the pulling vehicle, has a lower portion for engaging the lower peripheral edge of the pulling vehicle chassis, has retaining means on said harness lower portion for engaging the upper peripheral edge of the chassis to retain said harness on the chassis, and is adapted to firmly engage the pulling vehicle chassis over substantially the length of the chassis, to firmly resist longitudinal rocking forces that arise in the pulling operation and that tend to disconnect the harness from the pulling vehicle chassis; and a second coupling element supported by the harness, and adapted to be mounted on the pulling vehicle by means of the harness, for releasably coupling with the first coupling element.

* * * * *